US006513595B1

(12) United States Patent
Freiheit et al.

(10) Patent No.: US 6,513,595 B1
(45) Date of Patent: Feb. 4, 2003

(54) PORT COLLAR ASSEMBLY FOR USE IN A WELLBORE

(75) Inventors: Roland R. Freiheit, Edmonton (CA); Brett Gullory, Woodlands, TX (US); James F. Wilkin, Sherwood Park (CA)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/590,949

(22) Filed: Jun. 9, 2000

(51) Int. Cl.[7] ..... E21B 34/14
(52) U.S. Cl. ..... 166/332.4; 166/386; 166/334.4
(58) Field of Search ..... 166/316, 332.1, 166/332.4, 334.1, 334.4, 381, 386

(56) References Cited

U.S. PATENT DOCUMENTS

| | | | | |
|---|---|---|---|---|
| 3,335,802 A | * | 8/1967 | Seyffert | |
| 4,669,541 A | | 6/1987 | Bissonnette | 166/154 |
| 5,479,989 A | * | 1/1996 | Shy et al. | 166/332.4 |
| 5,484,017 A | | 1/1996 | Coon | 166/117.5 |
| 5,513,703 A | | 5/1996 | Mills et al. | 166/55.1 |
| 5,988,285 A | * | 11/1999 | Tucker et al. | 166/373 |
| 6,145,595 A | * | 11/2000 | Burris | 166/374 |

FOREIGN PATENT DOCUMENTS

| | | | |
|---|---|---|---|
| EP | 0 581 533 | 2/1994 | E21B/34/14 |
| EP | 0 618 345 | 10/1994 | E21B/33/14 |
| EP | 0 692 610 | 1/1996 | E21B/34/14 |
| GB | 2 129 848 | 5/1984 | E21B/34/10 |
| GB | 2 309 470 | 7/1997 | E21B/21/10 |

OTHER PUBLICATIONS

PCT Partial International Search Report from PCT/GB 01/02453, Dated Oct. 19, 2001.

* cited by examiner

*Primary Examiner*—David Bagnell
*Assistant Examiner*—Jennifer R Dougherty
(74) *Attorney, Agent, or Firm*—Moser, Patterson & Sheridan, L.L.P.

(57) ABSTRACT

The present invention generally provides a port collar assembly comprising a housing and a sleeve disposed therein. The sleeve is moveable between a first or opened and a second or closed position relative to the housing. In the closed position, the port collar prevents communication of the fluid between the exterior and interior of the port collar. In the open position, the port collar permits communication of the fluid between the exterior and interior of the port collar. The assembly includes a locking mechanism for the opened and closed positions comprising ratchet teeth formed on the exterior surface of the sleeve and mating ratchet teeth formed on the interior surface of the housing. The mating ratchet teeth are designed to secure the sleeve in a first position within the housing. A second set of mating ratchet teeth secures the sleeve in a second position.

15 Claims, 7 Drawing Sheets

PORT COLLAR ASSEMBLY FOR USE IN A WELLBORE

BACKGROUND OF THE INVENTION

1. Field of the Invention

The present invention relates to port collars for use in a tubular string. Specifically, the invention relates to a two-position port collar which can be repeatedly opened and closed and securely retained in each position.

2. Background of the Related Art

Port collars typically have a tubular housing which can be made up into a tubular string to form a part thereof. The port collar has a sliding sleeve disposed therein which may be used to selectively communicate fluid flow between an annular area of the well and an interior of the tubing string. In one example, a port collar is installed in a tubular string in a closed position and the tubular string is then inserted into a wellbore, locating the port collar at a predetermined depth in the well. Packing elements are installed above and below the port collar to isolate a specific zone of the annulus. Thereafter, the sliding sleeve of the port collar is remotely opened and the interior of the tubular is placed into communication with production fluid in the annulus. The port collar may also be used to permit fluid flow from the interior of the tubing string into the annulus of a well. For example, in cementing deep wells, a two-part cementing job is often used wherein the lower portion of a casing or liner string is cemented and then, using a port collar, the upper annulus is cemented to avoid hydrostatic pressures present in the lower portion of the annulus.

While many port collar designs have been made and used, certain problems exist with current designs. For example, most port collars rely on shear screws or some other type of mechanically shearable connection to unlock the sleeve from an initial position and permit movement of the sleeve to a second position within the collar. In a typical example, the shearable connection holds the sleeve in a closed position and then, when the collar is in the wellbore and ready to be opened, the shearable members are caused to fail with mechanical or hydraulic force. Once the shearable connection has failed, the sleeve is left prone to accidental shifting in the housing, unless it is permanently locked into either an open or closed position.

There is a need therefore, for a port collar that does not rely on a shearable connection to lock the sleeve into position within the housing. There is a further need for a port collar that can be repeatedly shifted and locked into the opened and closed positions. There is yet a further need for an easily shiftable port collar that can be used with other port collars in a single tubular string to create a larger assembly for selectively exposing different areas of an annulus to communication with the interior of the tubing string.

SUMMARY OF THE INVENTION

The present invention generally provides a port collar assembly comprising a housing and a sleeve disposed therein. The sleeve is moveable between a first or opened and a second or closed position relative to the housing. In the closed position, the port collar prevents communication of the fluid between the exterior and interior of the port collar. The assembly includes a locking system for each position comprising ratchet teeth formed on the exterior surface of the sleeve and mating ratchet teeth formed on the interior surface of the housing. One set of mating ratchet teeth are designed to secure the sleeve in an opened position within the housing and a second set of mating ratchet teeth secures the sleeve in a closed position. In one aspect of the invention, the ratchet teeth on the interior surface of the housing are formed on the inner surface of an inwardly biased C-ring disposed in a groove formed in the interior surface of the housing. A plurality of buttons are disposed within apertures formed in the exterior surface of the sleeve and the buttons can be urged in an outward radial direction by a shifting tool disposed within the sleeve. The buttons urge the C-rings into the grooves of the housing and out of engagement with the mating ratchet teeth formed on the surface of the sleeve. In this manner, the sleeve and housing are unlocked from each other and the tool can be shifted to the other position.

In another aspect of the invention, cavities and shifting shoulders are formed on the interior of the sleeve opposite each locking system. Corresponding unlocking and detenting formations are formed on a shifting tool including a formation designed to urge the buttons of the sleeve in a radial outward direction. A shifting surface on the shifting tool, corresponding to a shoulder formed on the interior of the sleeve, allows a force to be applied to move the sleeve to a second location in the housing after being unlocked.

In another aspect of the invention, several port collars are installed in a tubular string in a wellbore. Thereafter, in order to open and close the port collars, a number of shifting tools are run into the well on a run-in string in a pre-determined, spaced-apart orientation. The shifting tool at the lowest point on the string opens each port collar as it passes therethrough. In order to close the port collars, the string of shifting tools is pulled upwards and the shifting tool designed to close the port collars closes each collar as it passes therethrough. By accurately spacing the shifting tools along the run-in string, the direction of the string can be reversed in order to open a certain port collar while leaving the others in a closed position.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
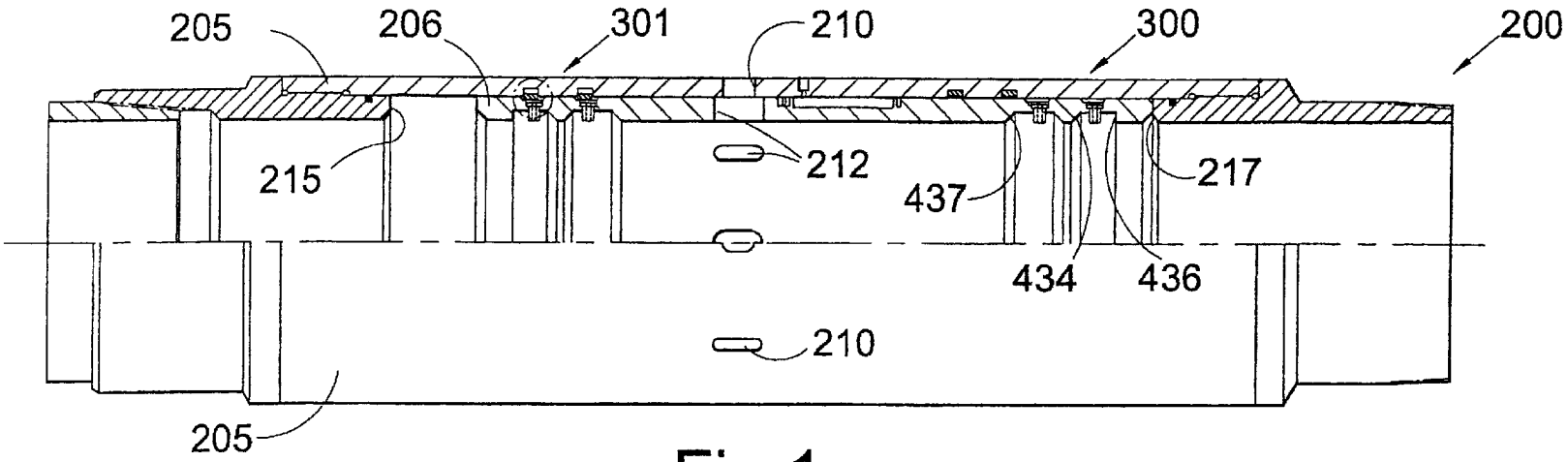
FIG. 1 is a partial section view showing the port collar of the present invention. in an open position.

FIG. 1 is a side view, partially in section of the port collar 200 of the present invention. The port collar 200 includes a housing 205, which is typically connected at each end to a tubular string (not shown). The housing 205 includes a plurality of housing apertures 210 formed in a wall thereof and constructed to align with sleeve apertures 212 formed in a wall of a sleeve 206 when the port collar 200 is in an open position as in FIG. 1. The sleeve 206 is disposed within the housing 205 and is installed therein in a certain rotational orientation which is predetermined and is secured with lock screws or set screws (not shown) between the housing 205 and the sleeve 206. Axial movement of the sleeve 206 within the housing 205 is limited by stops 215, 217 formed at each end of the interior of the housing 205. The stops prevent axial movement of the sleeve 206 within the housing beyond that movement necessary to locate the sleeve 206 in the open or closed position.

The port collar 200 includes a first locking system, generally labeled 300 to retain the sleeve 206 in a closed position and a second locking system 301 to retain the sleeve in an open position. In FIG. 1, locking system 301 is engaged and the port collar 200 is locked in the open position with fluid communication possible between the inside and outside of the port collar 200 through aligned apertures 210, 212. The sleeve 206 is prevented from axial movement in a first direction by stop 217 and in the direction of the closed position by engaged locking system 301.

Figure 1A:
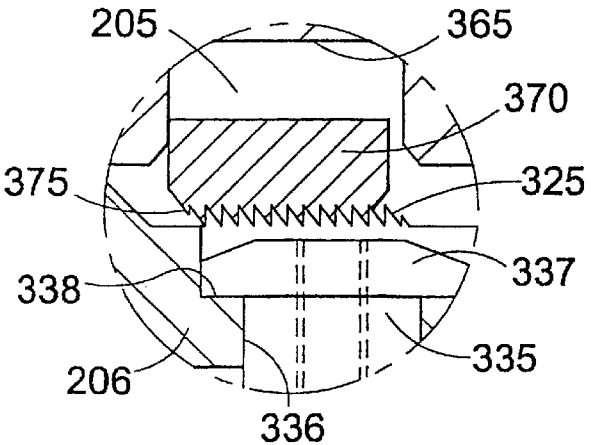
FIG. 1A is an enlarged view of a locking portion of the port collar of FIG. 1.

Each locking system 300, 301 includes locking surfaces formed on the perimeter of the sleeve 206 and locking surfaces formed on the inner surface of the housing 205. The surfaces prevent the sleeve 206 from moving within the housing 205 in one direction. FIG. 1A is an enlarged view showing a portion of engaged locking system 301. Specifically, the locking surface formed on the sleeve 206 includes ratchet teeth 325 extending around the sleeve perimeter. In the preferred embodiment, the mating locking surface of the housing 205 includes at least one groove 365 formed in the inner surface of the housing with an inwardly biased C-ring 370 disposed therein. On the inside surface of the C-ring 370, facing the sleeve 206, ratchet teeth 375 are formed and are designed to interact with ratchet teeth 325 formed on the exterior of the sleeve 206 such that the sleeve 206 is prevented from axial movement in the housing 205 in a first direction when the mating teeth 325, 375 of the sleeve and the C-ring are engaged. As depicted in FIG. 1A, the engaged ratchet teeth 325, 375 will move across each other with little resistance in a first direction but will interfere with each other preventing movement in a second direction. Specifically, the design allows the ratchet teeth 325, 375 to move across each other as the port collar 200 is shifted to the open position shown in FIG. 1. Thereafter, the interaction of the teeth 325, 375 prevent the sleeve 206 from moving back towards the closed position. In the open position therefore, the sleeve 206 is prevented from axial movement in one direction by stop 217 acting between the sleeve 206 and the housing 205 and in the opposite direction by the locking system 301.

Interspersed with the ratchet teeth 325 on the outer perimeter of the sleeve 206 are at least one button 335, one of which is visible in FIG. 1A. The buttons 335 are housed in countersunk apertures 336 formed in the sleeve 206 and a head portion 337 of each button 335 is retained on a reduced diameter shoulder 338 formed in each aperture. The buttons can be urged outwardly radially by a shifting tool described hereafter. The placement of apertures 336 with the buttons 335 therein correspond to the location of the ratchet teeth 325 formed on the outer surface of the sleeve 206 such that the buttons 335, when urged outwards, extend out above the ratchet teeth 325. By urging the buttons outward, the head portion 337 of the buttons move the inwardly biased C-ring 370 back into the groove 365 and out of engagement with the ratchet teeth 325 of the sleeve. In this manner, the locking system 301 is unlocked and the sleeve 206 can be moved axially within the housing 205. The number of buttons utilized can be increased for redundancy. Additionally, each locking system can utilize multiple locking surfaces. For example, if a particular tool is run through a port collar and one set of buttons is inadvertently urged outwards thereby disengaging a first C-ring, a second C-ring with its locking surface will remain engaged with corresponding ratchet teeth of the sleeve, thereby preventing premature shifting of the port collar.

Figure 2:
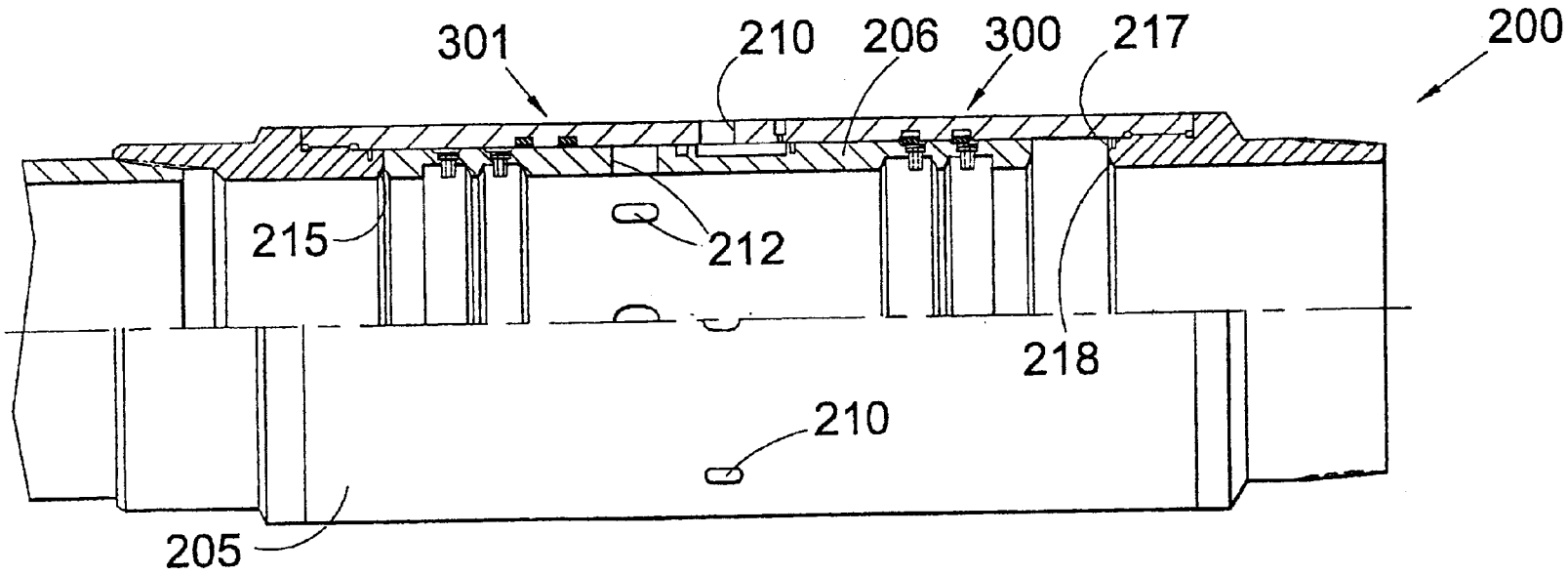
FIG. 2 is a partial section view of the port collar in a closed position.

FIG. 2 is a partial section view showing the port collar 200 in a closed position with the sleeve apertures 212 out of alignment with the housing apertures 210. In the closed position, there is no fluid communication between the interior and exterior of the port collar 200. As with locking system 301, locking system 300 includes ratchet teeth formed on the exterior of the sleeve 206 and ratchet teeth formed on the inside surface of a C-ring housed in a groove formed on the inside surface of housing 205. In the closed position, the sleeve 206 is prevented from movement in a first axial direction by stop 215 and in the direction of the open position by the engaged locking system 300.

Figure 3:
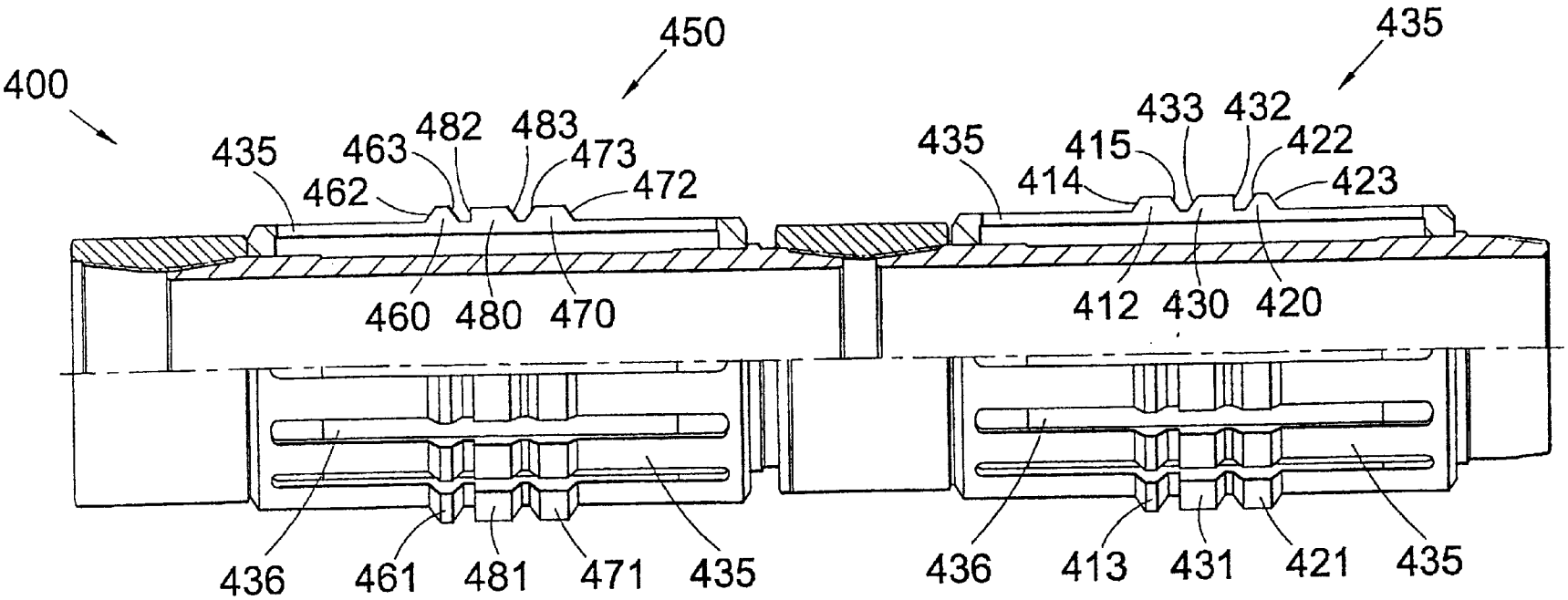
FIG. 3 is a perspective, side view of a shifting tool used to open the port collar including an opening portion and a closing portion.

Unlocking and shifting of the port collar 200 between the open and closed positions are performed through the use of a shifting tool. FIG. 3 is a perspective view of shifting tool 400 which is comprised of an opening portion 410 and closing portion 450, each portion having an opposing orientation along the length of the shifting tool. Portions 410, 450, when run into the wellbore, are independently seated in the interior of the port collar sleeve 206. FIG. 3 illustrates the opening portion 410 including a tool oriented to open the port collar 200 and closing portion 450 oriented to close the port collar 200. The spacing between the opening 410 and closing 450 portions is adjustable depending upon operational conditions and requirements. Each portion 410, 450 of the shifting tool 400 includes collet-like features with a plurality of slots 436 formed longitudinally within the tool. The slots create fingers 435 therebetween which move in a spring-like manner when force is applied to the surface thereof. In the preferred embodiment, at least four equally spaced fingers 435 are formed around the shifting tool 400.

Considering the opening portion 410 of the tool in greater detail, each finger 435 includes two unlocking formations 412, 430 designed to interact with corresponding surfaces on the interior of the sleeve 206. Unlocking formation 430 also serves to move the sleeve 206 within the housing 205 via engagement between surfaces of the formation 430 and the sleeve 206. Unlocking formations 412, 430 include upper surfaces 413, 431 substantially parallel to the surface of finger 435 and three angled surfaces 414, 415, 433. Unlocking formation 430 also includes one shifting surface 432 substantially perpendicular to the surface of finger 435. The shifting surface 432 provides a means to urge the sleeve 206 from the closed to the open position as described hereafter. A detenting formation 420 has one upper surface 421 substantially parallel to finger 435 and two angled surfaces 422, 423.

Closing portion 450 similarly includes two unlocking formations 470, 480 and are detenting formation 460. As with the opening portion, formations 480, 470 include surfaces 481, 471 substantially parallel to the surface of finger 435 and three angled surfaces 483, 472, 473. Additionally, shifting formation 480 includes shifting surface 482 substantially perpendicular to finger 435. A detenting formation 460 includes an upper surface 461 and also a two surfaces 462, 463 angled to the surface of finger 435.

Figure 4:
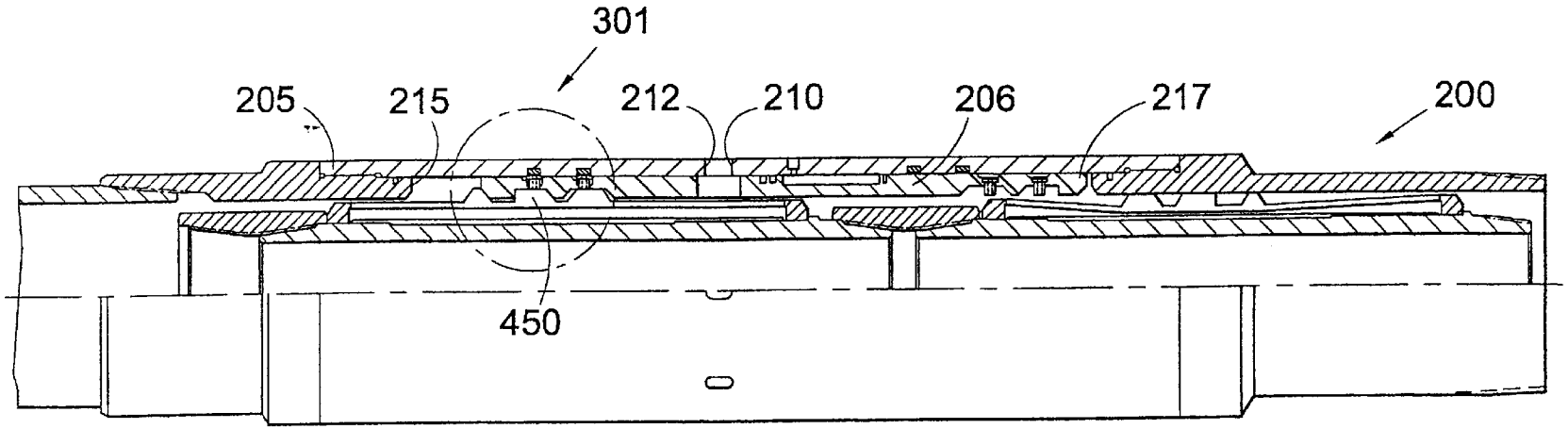
FIG. 4 is a section view showing the port collar in the open position with a shifting tool installed therein.
Figure 4A:
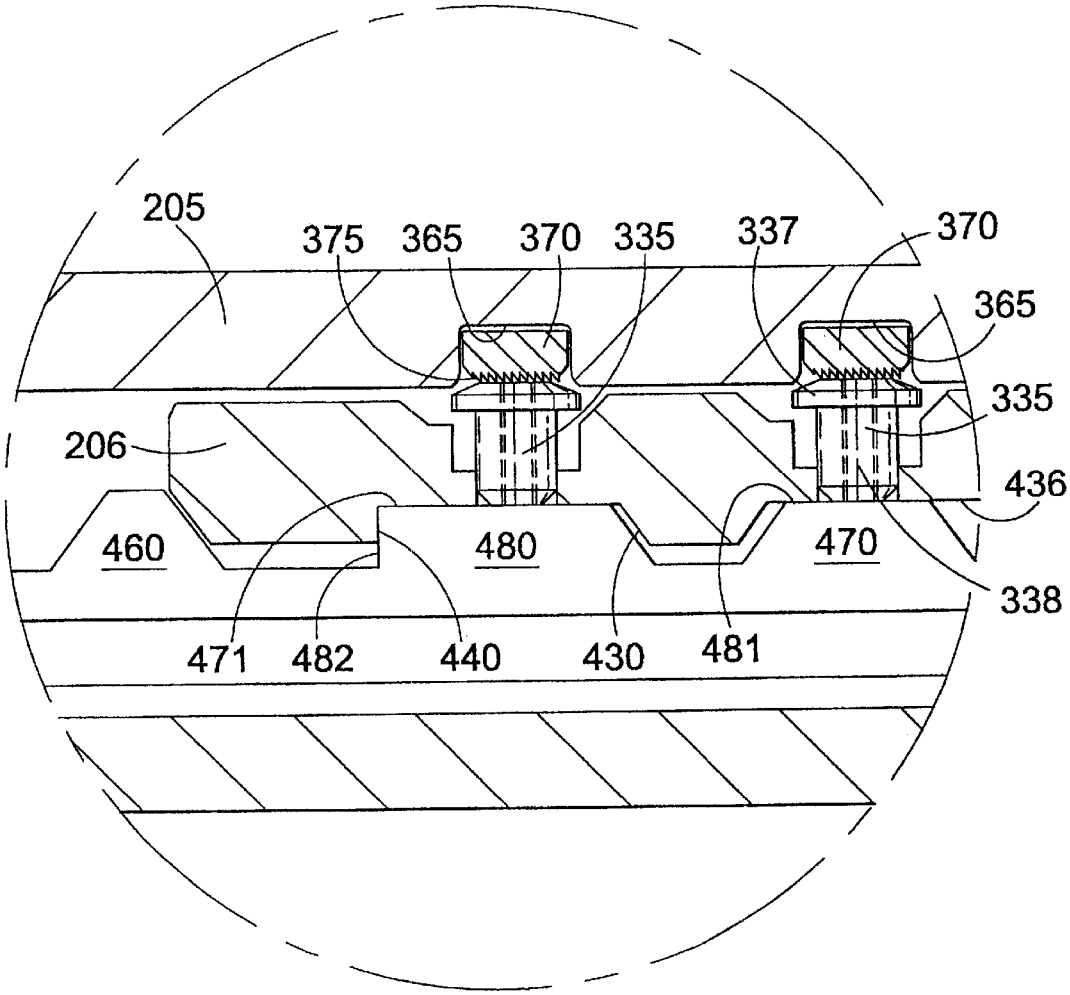
FIG. 4A is an enlarged view showing the opening portion of the shifting tool engaged in the sleeve of the port collar.

Formed in the interior of the sleeve 206, opposite each locking system 300, 301 are cavities constructed and arranged to interact with the formations and surfaces of the shifting tool 400. FIG. 4 is a partial section view of the port collar 200 showing the closing portion 450 of the shifting tool 400 engaged with the corresponding cavities in the sleeve opposite locking system 301. With the closing portion 450 of the shifting tool 400 inserted, the sleeve 206 may be urged in the direction of stop 215, mis-aligning the apertures 210, 212 of the sleeve and housing and closing the port collar 200. As illustrated in FIG. 4A, an enlarged view of locking system 301, formations 460, 470, 480 of the closing portion 450 of the shifting tool 400 have engaged corresponding cavities of the sleeve 206. The interior of the sleeve 206 opposite locking system 301 includes two unlocking cavities 430, 436 and one shifting shoulder 440 constructed and arranged to interact with unlocking formations 470, 480 and detenting formation 460 formed on the closing portion 450 of the shifting tool 400. In FIG. 4A, shifting surface 482 of the shifting tool is in contact with shoulder 440 of the sleeve 206. Surfaces 481, 471 of formations 470, 480 have contacted the lower surface 338 of buttons 335 disposed in the sleeve 206 and the buttons have been urged outwards in a radial direction. The head portion 337 of each button 335 has contacted and urged the C-rings 370 into the grooves 365 formed on the interior surface of the housing 205. In this manner, the ratchet teeth 375 have been moved out of engagement with the mating ratchet teeth 325 (not visible) on the exterior of the sleeve 206.

With the ratchet teeth 325, 375 out of engagement, force applied against shoulder 440 by shifting surface 482 will cause the sleeve 206 to move axially within the housing 205. As the sleeve 206 moves into the closed position, axial movement of the sleeve 206 is limited by stop 215 and locking system 301 will prevent axial movement towards the open position, thereby locking the port collar 200 in the closed position. As visible in FIG. 1, there are two cavities 437, 434 and a shifting shoulder 436 opposite locking system 300 to interact with formations 412, 430 and shifting surface 432 of the opening portion 410 of the shifting tool 400. Locking system 300 is disengaged in a similar manner as locking system 301 and those skilled in the art will appreciate that the foregoing description is equally applicable to locking system 300.

Figure 5:
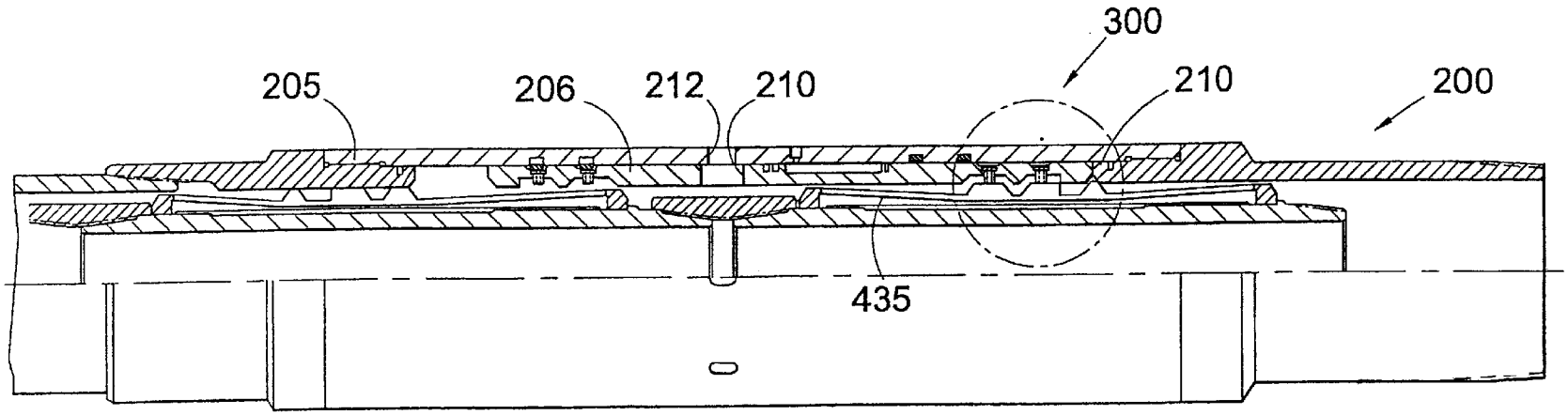
FIG. 5 is a section view showing a collet-like function of the shifting tool.
Figure 5A:
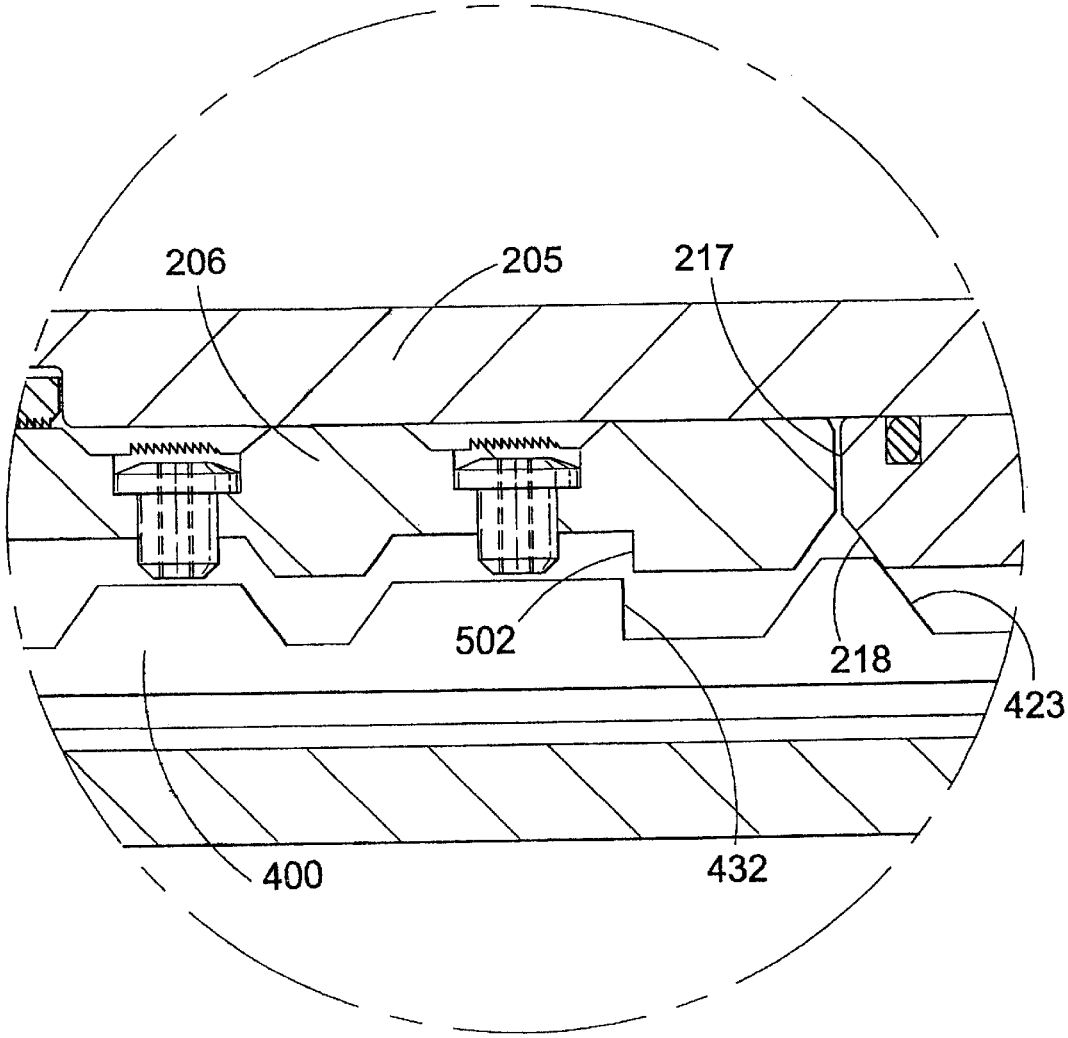
FIG. 5A is an enlarged view thereof.

FIG. 5 is a partial section view of the port collar 200 having been shifted to the open position by the opening portion 410 of the shifting tool 400. FIG. 5 illustrates the collet-like movement of the fingers 435 allowing the opening portion 410 of the shifting tool 400 to be urged out of engagement with the sleeve 206. FIG. 5A is an enlarged view showing the interaction of the various surfaces of the shifting tool 410, sleeve 206 and housing 205. After the port collar is shifted to the open position and additional axial movement of the sleeve 206 is prevented by stop 217, continued force applied to the shifting tool will cause a surface 423 of the detenting formation 420 to contact and move downward across an undercut surface 218 of the sleeve 206 formed below stop 217. The downward component of force exerted upon surface 423 urges the flexible finger 435 downward until shifting surface 432 is no longer in contact with corresponding shoulder 502 of sleeve 206. In this manner, the shifting tool 400 can be moved out of engagement with the port collar.

Typically, a port collar 200 is placed in a well in the closed position whereby the annular area around the port collar 200 is isolated from the interior of the port collar. In order to open the port collar 200, a shifting tool 400 is run into the well on a run-in string of tubular. The opening 410 and closing 450 portions of the shifting tool 400 allow the port collar 200 to be opened and then closed again at the completion of some downhole operation. As the shifting tool enters the closed port collar, the opening portion 410 passes through the formations opposite the locking system 301 and subsequently, the opening portion 410 interacts with formations opposite the locking system 300 and the shifting tool becomes fixed within the sleeve 206. In this position, the shifting tool urges the buttons 335 of the locking system 300 outwards thereby moving the C-rings 370 out of engagement with the ratchet teeth 325 of the sleeve. Continued force applied to the shifting tool 400 will then urge the sleeve 206 down and into the open position. Thereafter, continued force upon the shifting tool 400 causes the collet-like fingers of the opening portion 410 of the shifting tool to collapse and come out of engagement with cavities of the sleeve 206, as illustrated in FIG. 5A.

Figure 6:
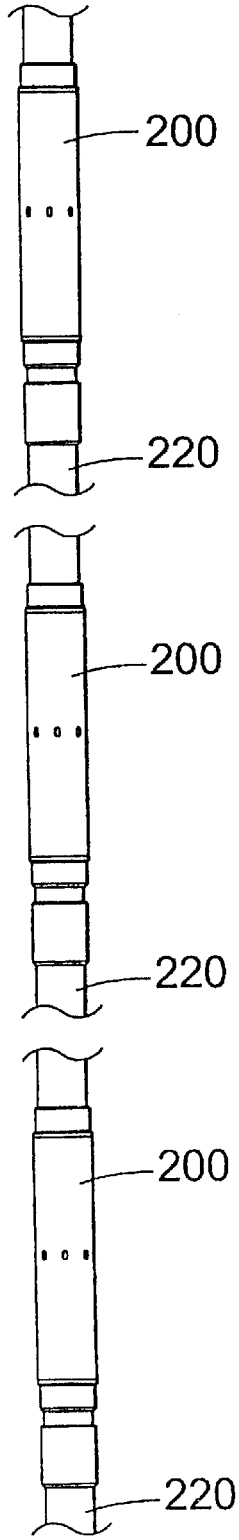
FIG. 6 is a side view of a wellbore showing a plurality of port collars disposed on a string of tubulars.

The present invention can also be used in a wellbore wherein numerous port collars 200 are arranged in series at various depths in the well and are then alternately opened or closed by multiple shifting tools run into the well along a run-in string. FIG. 6 is a side view of a wellbore showing a plurality of port collars 200 disposed on a string of tubulars 220. For example, port collars 200 can be located adjacent formations and then selectively opened to access production fluid. Subsequently, the port collars 200 can be re-closed isolating the interior thereof from the annular well fluid. In other examples, the port collars 200 are opened to permit cement to be injected into the annular area therearound and then re-closed after the cementing process is complete.

As a run-in string with shifting tools installed therein is lowered into a wellbore, the opening tool portion 410 of the shifting tool opens the port collars as it passes therethrough. Closing portion 450 of the shifting tool, because it is designed to operate only while moving in an upward direction through the port collars 200, passes downward through the port collars 200 with no effect. After the shifting tool 400 has passed through and opened all of the port collars 200, the run-in string housing the shifting tools can be pulled upwards towards the surface of the well such that the closing portion of a shifting tool 450 will re-close the lower most port collars. Finally, if necessary, the opening portion 410 of the shifting tool 400 can then be lowered back through an intermediate port collar(s), leaving the port collar(s) in the open position. In this manner, port collars are selectively opened and closed in a string of multiple port collars.

While foregoing is directed to the preferred embodiment of the present invention, other and further embodiments of the invention may be devised without departing from the basic scope thereof, and the scope thereof is determined by the claims that follow.

What is claimed is:

1. A removable shifting tool for moving a port collar sleeve between an open and a closed position within a port collar, the shifting tool comprising:

a body having slots formed longitudinally therein and flexible members therebetween;

a plurality of formations on the surface of the flexible members, the formations constructed and arranged to move at least one button housed in a sleeve of a port collar in a radially outward direction; and a second formation having a shifting surface formed thereupon for mating with a corresponding shoulder formed in an inside surface of the port collar sleeve, the shifting surface and shoulder allowing a force to be applied to the sleeve to shift the sleeve from a first to a second position within a housing, the shifting tool insertable and removable from the port collar.

2. A port collar comprising:

a housing with at least one aperture through a wall thereof;

a sleeve disposed within the housing, the sleeve shiftable between an open and closed position in relation to the housing, the sleeve having at least one aperture in a wall thereof to align with the at least one aperture in the housing when the sleeve is in the open position, thereby permitting fluid communication between an outside and an inside of the port collar; and a locking system to retain the sleeve in the open or closed position, the locking system including a first and second locking surfaces each including ratchet teeth formed around the outer perimeter of the sleeve and a first and second mating locking surfaces each including an opposing ratchet teeth, whereby the ratchet teeth and the opposing ratchet teeth move across each other in a first direction but interfere with each other in an opposite direction, thereby retaining the sleeve in the opened or closed position within the housing.

3. An apparatus for selectively passing a fluid between an annular area in a wellbore and an interior of the apparatus, comprising:

an outer member;

an inner member lockable in a fluid passing position and lockable in a non-fluid passing position, whereby the inner member can be unlocked and moved between the fluid passing position and the non-fluid passing position using an insertable and removable shifting tool; and whereby the apparatus is locked in the fluid passing position by interference between a surface of the inner member and a surface of a ring member housed in the outer member.

4. The apparatus of claim 3, whereby the apparatus is locked in the non-fluid passing position by interference between a surface of the inner member and a surface of a ring member housed in the outer member.

5. The apparatus of claim 4, whereby the apparatus is unlocked by displacing the ring member.

6. The apparatus of claim 5, whereby the ring member is displaced by a moveable surface urged radially outward from the surface of the inner member.

7. A port collar comprising:

a housing with at least one aperture through a wall thereof;

a sleeve disposed within the housing, the sleeve shiftable between an open and closed position in relation to the housing, the sleeve having at least one aperture through a wall thereof to align with the at least one aperture in the housing when the sleeve is in the open position thereby permitting fluid communication between an outside and inside of the port collar; and a locking system to retain the sleeve in the open or closed position, wherein the locking system includes a first locking surface formed upon a perimeter of the sleeve and a first mating locking surface disposed upon an inner surface of the housing to prevent axial movement of the sleeve in a first direction with respect to the housing and a second locking surface formed upon the perimeter of the sleeve and a second mating locking surface disposed upon the inner surface of the housing to prevent axial movement of the sleeve in a second direction with respect to the housing, whereby the first and second mating locking surfaces are formed upon the inner surface of an inwardly biased C-ring disposed in a groove formed in the inner surface of the housing, the C-ring expandable in an outward direction into the groove.

8. The assembly of claim 7, wherein each of the first and second locking surfaces include ratchet teeth formed around the outer perimeter of the sleeve and each of the first and second mating locking surfaces include an opposing row of ratchet teeth, whereby the rows of ratchet teeth and the opposing rows of ratchet teeth move across each other in a first direction but interfere with each other in an opposite direction, thereby retaining the sleeve in the opened or closed position within the housing.

9. The assembly of claim 8, further including at least one button disposed in an aperture formed in the locking surface of the sleeve, the button movable in an outwardly radial direction to cause the expandable C-ring to expand into the groove and move the mating locking surface of the housing out of engagement with the locking surface of the sleeve, thereby allowing axial movement of the sleeve in the first direction.

10. The assembly of claim 9, further including at least one button disposed in an aperture formed in the locking surface of the sleeve, the button movable in an outwardly radial direction to cause the expandable C-ring to expand into the groove and move the mating locking surface of the housing out of engagement with the locking surface of the sleeve, thereby allowing axial movement of the sleeve in the second direction.

11. The assembly of claim 10, wherein the sleeve is movable between the open and closed positions by a shifting tool inserted therein.

12. The assembly of claim 11, wherein the shifting tool includes a plurality of longitudinally formed slots, creating flexible fingers therebetween.

13. The apparatus of claim 12, wherein the flexible fingers of the shifting tool include a formation formed on the outer surface thereof, the formation constructed and arranged to urge at least one button in an outwardly radial direction, thereby unlocking the locking system and permitting movement of the sleeve in the first direction.

14. The apparatus of claim 13, wherein the flexible fingers of the shifting tool include a formation formed on the outer surface thereof, the formation constructed and arranged to urge at least one button in an outwardly radial direction, thereby unlocking the locking system and permitting movement of the sleeve in the second direction.

15. The apparatus of claim 14, wherein the formations formed on the flexible fingers serve to fix the flexible fingers within the sleeve.

* * * * *

UNITED STATES PATENT AND TRADEMARK OFFICE

CERTIFICATE OF CORRECTION

PATENT NO. : 6,513,595 B1 
DATED : February 4, 2003
INVENTOR(S) : Roland R. Freiheit, Brett Gullory and James F. Wilkin It is certified that error appears in the above-identified patent and that said Letters Patent is hereby corrected as shown below:

Title page,
Item [75], Inventors, should read -- Roland R. Freiheit
Brett Guillory
James F. Wilkin --

Signed and Sealed this

Twenty-fifth Day of November, 2003

JAMES E. ROGAN
*Director of the United States Patent and Trademark Office*